US011261884B2

(12) United States Patent
Händle et al.

(10) Patent No.: US 11,261,884 B2
(45) Date of Patent: Mar. 1, 2022

(54) ELECTRO-HYDROSTATIC DRIVE SYSTEM

(71) Applicant: MOOG GmbH, Boeblingen (DE)

(72) Inventors: Werner Händle, Marbach (DE); Achim Helbig, Stuttgart (DE); Tino Kentschke, Weil der Stadt (DE); Reiner Kohlhas, Osburg (DE); Klaus Kirch, Aachen (DE)

(73) Assignee: Moog GmbH, Boeblingen (DE)

( * ) Notice: Subject to any disclaimer, the term of this patent is extended or adjusted under 35 U.S.C. 154(b) by 0 days.

(21) Appl. No.: 16/320,915

(22) PCT Filed: Jul. 14, 2017

(86) PCT No.: PCT/EP2017/067912

§ 371 (c)(1),
(2) Date: Jan. 25, 2019

(87) PCT Pub. No.: WO2018/019622

PCT Pub. Date: Feb. 1, 2018

(65) Prior Publication Data

US 2019/0162208 A1 May 30, 2019

(30) Foreign Application Priority Data

Jul. 27, 2016 (DE) ..... 102016113882.7

(51) Int. Cl.
*F15B 15/18* (2006.01)
*F15B 1/02* (2006.01)

(52) U.S. Cl.
CPC ..... *F15B 1/024* (2013.01); *F15B 15/18* (2013.01); *F15B 2211/785* (2013.01)

(58) Field of Classification Search
CPC .. F15B 2211/785; F15B 1/024; F15B 11/024; F15B 15/18
See application file for complete search history.

(56) References Cited

U.S. PATENT DOCUMENTS

RE32,588 E 2/1988 Bowen
2010/0154399 A1 6/2010 Bergstroem
(Continued)

FOREIGN PATENT DOCUMENTS

DE 102009043034 A1 3/2011
DE 102011116964 A1 5/2012
(Continued)

*Primary Examiner* — F Daniel Lopez
(74) *Attorney, Agent, or Firm* — Harter Secrest & Emery LLP

(57) ABSTRACT

The present invention relates to an electro-hydrostatic system (1) with a hydraulic machine (11) which is driven by an electric motor (10) and has a variable volume and/or rotational speed for providing a volumetric flow rate of a hydraulic fluid, a differential cylinder (20) with a piston surface and with an annular surface, and at least one equalization container (30, 37), wherein the drive system (1) has a closed hydraulic circuit and during operation has an overpressure relative to the environment by means of the hydraulic machine (11) and/or a pretensioning source (15, 37), and the drive system (1) provides a movement of the cylinder in a first direction by means of a volumetric flow rate of the hydraulic machine (11) and a volumetric flow rate from the equalization container (30, 37), and provides a movement in a second direction by means of a volumetric flow rate of the hydraulic machine (11) and a volumetric flow rate into the equalization container (30, 37), and a power operating mode and a speed operating mode are provided with the differential cylinder (20).

10 Claims, 5 Drawing Sheets

(56) References Cited

U.S. PATENT DOCUMENTS

Figure 1A:
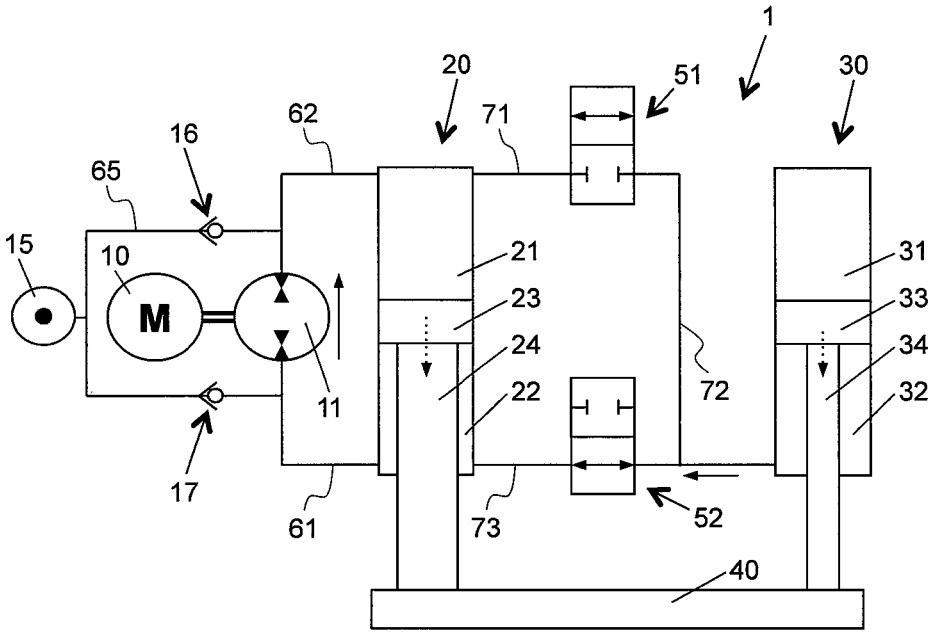

| | | | | |
|---|---|---|---|---|
| 2011/0192157 | A1* | 8/2011 | Ogawa | F15B 15/149 60/469 |
| 2012/0272708 | A1 | 11/2012 | Scheidl | |
| 2017/0108014 | A1 | 4/2017 | Haendle | |

FOREIGN PATENT DOCUMENTS

| | | | |
|---|---|---|---|
| GB | 1048285 | | 11/1966 |
| JP | 2007-146867 | A | 6/2007 |
| WO | WO-2012/062416 | A1 | 5/2012 |

* cited by examiner

ELECTRO-HYDROSTATIC DRIVE SYSTEM

The present invention relates to an electro-hydrostatic drive system which serves to provide various movement sequences. The system can be used in a multitude of machines; in particular, it is used for hydraulic presses, deep-draw machines, or injection molding machines. Such machines normally have a plurality of movement sequences or operating modes. One of these movement sequences is what is known as a power operating mode, wherein sufficient force is applied at low speed to the workpiece to be machined so that—for example in a press or a deep-draw installation—the workpiece deforms. Another of these movement sequences is what is known as a speed operating mode, with which less force is exerted, but which enables a faster movement of the machine, for example for releasing the deformed workpiece.

Electro-hydrostatic drive systems are known in the prior art. However, these have the disadvantage that they realize only one of the mentioned movement sequences. Other drive systems have the disadvantage that they require very many components or have a high power consumption; this can lead to disadvantages in initial costs and maintenance costs.

Based on this prior art, it is an object of the present invention to at least partially overcome or improve upon the disadvantages of the prior art.

The object is achieved with a device according to claim 1. Preferred embodiments and modifications are the subject matter of the sub-claims.

An electro-hydrostatic drive system according to the invention has a hydraulic machine which is driven by an electric motor and has a variable volume and/or rotational speed. This serves to provide a variable volumetric flow rate of a hydraulic fluid in a closed hydraulic circuit. Operation in two flow directions is preferably possible with the hydraulic machine. The hydraulic machine may further comprise either an electric motor with variable rotational speed and a fixed displacement pump, or an electric motor with constant rotational speed and a variable displacement pump, or an electric motor with variable rotational speed and a variable displacement pump. The selection of the hydraulic machine is thereby determined by factors such as, for example, system costs, reliability, or permitted noise emission, or efficiency.

An electro-hydrostatic system according to the invention furthermore comprises a differential cylinder. A differential cylinder is understood to mean a hydraulic cylinder in which the cylinder surfaces differ on the front and rear sides of the piston. The side with the smaller cylinder surface is referred to as the rod side because a piston rod is arranged on this side. The cylindrical surface on the rod side is called an annular surface. The side with the larger cylindrical surface of a differential cylinder is what is known as the piston side. Either no piston rod, or a piston rod having a smaller diameter than on the rod side, is arranged on the piston side. The cylinder surface on the piston side is called the piston surface.

An electro-hydrostatic system according to the invention further comprises at least one equalization container.

According to an exemplary embodiment of the present invention, the equalization container is a pressure vessel that, according to a further preferred embodiment, in addition to a predetermined pressure has a variable volume for the hydraulic fluid accommodated in the equalization container. Alternatively, a plurality of equalization containers may also be provided, wherein in a further preferred embodiment of the present invention the equalization container is designed as a second cylinder, in particular as a double-rod or single-rod cylinder.

In a further preferred embodiment of an electro-hydrostatic system according to the invention, the equalization container may in particular also be designed as a pressure accumulator and/or as a second cylinder.

The volumes to be conveyed, which volumes the hydraulic machine and/or a preload source. also referred to herein as a pretensioning source. must transport for the movement sequences, are advantageously reduced by pretensioning, that is. by preloading to a pressure that is greater than surrounding atmospheric pressure. the hydraulic fluid by means of the at least one equalization container in the closed hydraulic circuits.

The variable volume may moreover be realized with further, different devices. For example, any geometric shapes with elastic walls may be used.

An electro-hydrostatic system according to the invention has a closed hydraulic circuit. Such a system is thus sealed off from its environment in normal operation. In safety-critical situations or for maintenance etc., however, an exchange of the hydraulic fluid with the environment is possible, for example the targeted discharging of hydraulic fluid during maintenance and servicing.

In operation, the system has an overpressure with respect to the environment, that is. the hydraulic pressure of the system is greater than surrounding atmospheric pressure. This overpressure is generated by means of the hydraulic machine and a pretensioning source connected with the hydraulic machine, and/or by means of a pretensioning source connected elsewhere to the system. This pretensioning source may, for example, be realized as an additional pressure vessel; however, the pretensioning source may also be implemented by the aforementioned second cylinder or by both. In principle, an internal or external pretensioning source may be used.

The drive system provides a movement of a piston within the cylinder, i.e. of the differential cylinder, in a first direction, e.g. toward the workpiece to be machined. This is achieved by means of a volumetric flow rate of the hydraulic machine and a volumetric flow rate from or into the equalization container. In this instance, a controller and additional components—e.g. valves—may coordinate the volumetric flow rate in accordance with the required movement sequences. Furthermore, the drive system provides a movement of the piston within the cylinder in a second direction, e.g. in the direction opposite the first direction. This is also achieved by means of a volumetric flow rate of the hydraulic machine and a volumetric flow rate into or out of the equalization container.

An electro-hydrostatic system according to the invention provides at least a power operating mode and a speed operating mode. These operating modes are provided with the differential cylinder of the first cylinder. The differential cylinder may be realized as a cylinder or as a plurality of cylinders operating in parallel. These additional cylinders may optionally have a different piston movement sequence than the differential cylinder (master cylinder); however, they are part of the electro-hydrostatic system according to the invention, and part of the closed hydraulic circuit.

In one embodiment of the system, in particular if the equalization container is configured as a hydraulic cylinder, it can be a differential cylinder. Its annular surface may thereby correspond to the difference between the piston surface and the annular surface of the first cylinder. This has the advantage that, given a closed hydraulic circuit, an additional equalization container is no longer required, or this only needs to be equipped with a reduced volume.

An electro-hydrostatic system according to the invention has valves to realize the movement sequences. In one embodiment of the system, a 2/2-port directional control valve is arranged between the equalization container and the annular side of the first cylinder. This is controlled by means of the cited control, and possibly using additional components. Alternatively or in addition to this, a check valve may be arranged between the equalization container and the annular side of the first cylinder. If only one check valve is used, the control for this valve is advantageously omitted.

In one embodiment of the system, the pretensioning source is arranged parallel to the hydraulic machine. A portion of the pressure or volume required for a movement sequence is thereby applied by this pretensioning source and ensures greater dynamics of the system and a pretensioning of the closed circuit. The pretensioning source prevents cavitation of the hydraulic machine upon pressure buildup or dynamic volumetric flow rate demand.

In one embodiment of the system, both sides of the hydraulic machine are connected with the pretensioning source for transmitting a pretensioning in the hydraulic fluid of the closed circuit. This has the advantage that the pretensioning source may support both the first and the second direction of movement by providing additional pressure and/or volume. Cavitation in the hydraulic machine is advantageously also avoided in pressure build-up phases or given non-ideally balanced cylinder surfaces between master cylinder and cylinder equalization container. Cavitation leads to increased wear or failure of the hydraulic machine and must be prevented.

In one embodiment of the system, the piston rod of the first cylinder and the piston rod of the second cylinder are mechanically coupled. Due to this mechanical coupling, a portion of the volumetric flow that is required for a movement sequence is forced between the first cylinder and the second cylinder.

In a preferred embodiment of the system, the annular area of the first cylinder is less than or equal to the annular area of the second cylinder. In the corresponding switch position, a speed operating mode may therefore be provided by means of the annular side of the first cylinder, and a power operating mode may also be provided in combination with the second cylinder and the combinations of the two annular surfaces of the annular chambers. A system is also provided in which the full process force may be transmitted via piston rod 24 in the power operating mode, and at the same time the critical load of the piston rod 24 may be kept low. In one embodiment of the system, the piston rod of the second cylinder is mechanically coupled with a weight ($m_2$). In this instance, the weight acts so that it contributes to increasing the pressure in the second cylinder. An increase in the pretensioning in the closed hydraulic system is thereby ensured, and a portion of the pressure required for a movement sequence is therefore applied by this pretensioning source and ensures greater dynamics of the system and avoids cavitation in the hydraulic machine.

In one embodiment of the system, the pretensioning source and the second cylinder are combined such that the piston side of the second cylinder is connected to the pretensioning source (i.e., the chamber not directly integrated into the hydraulic circuit) to transmit a pre-tension in the hydraulic fluid of the closed circuit. This may be used to separate media between the oil of the closed loop and nitrogen, for example. In certain embodiments, a mechanical coupling between the piston rod of the first cylinder and the piston rod of the second cylinder, and/or a weight on the piston rod of the second cylinder, may also thereby be omitted. However, it is also within the meaning of the present invention to combine the individual embodiments, in particular in order to combine individual advantages of the individual components in certain operating states with one another.

In one embodiment of the system, both sides of the pump/hydraulic machine are operatively hydraulically connected to the first cylinder in both power operating mode and speed operating mode. This can advantageously be achieved so that the first cylinder is capable of realizing both a power operating mode and a speed operating mode for both the first movement direction and also the second movement direction.

The invention is explained in the following on the basis of various exemplary embodiments, wherein it is noted that this example encompasses modifications or additions as they immediately arise to the person skilled in the art.

Figure 1B:
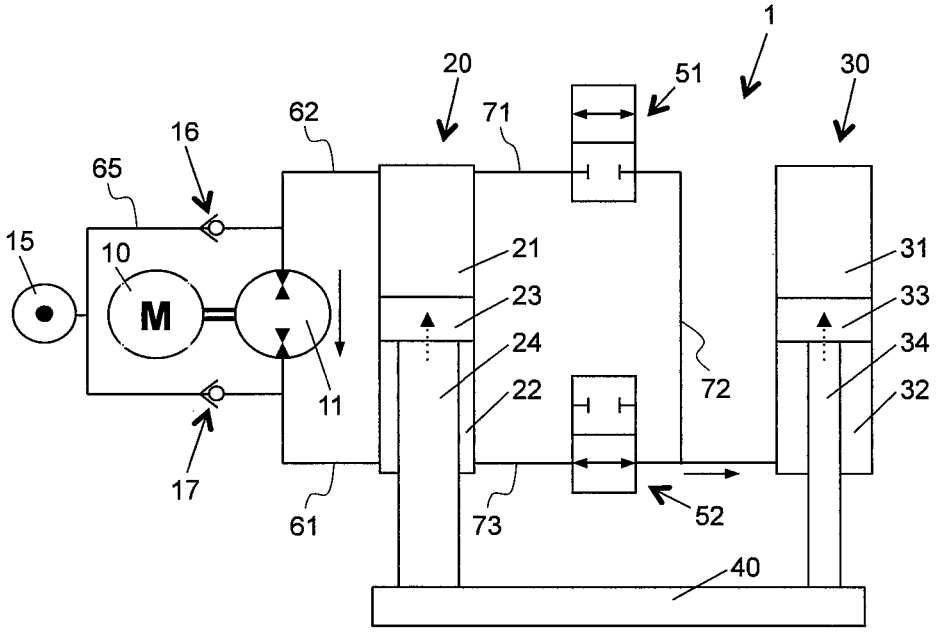
Figure 2A:
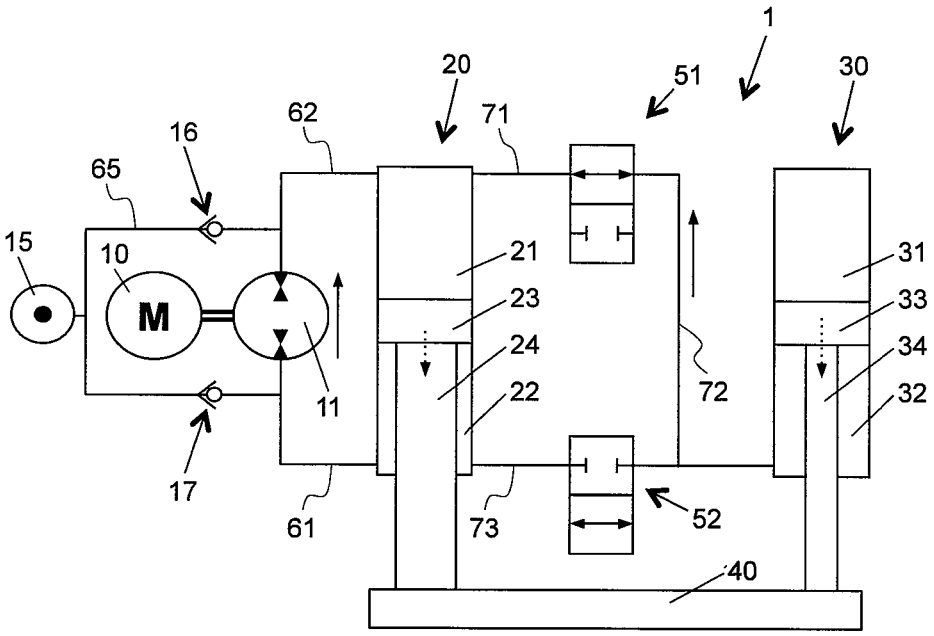
Figure 2B:
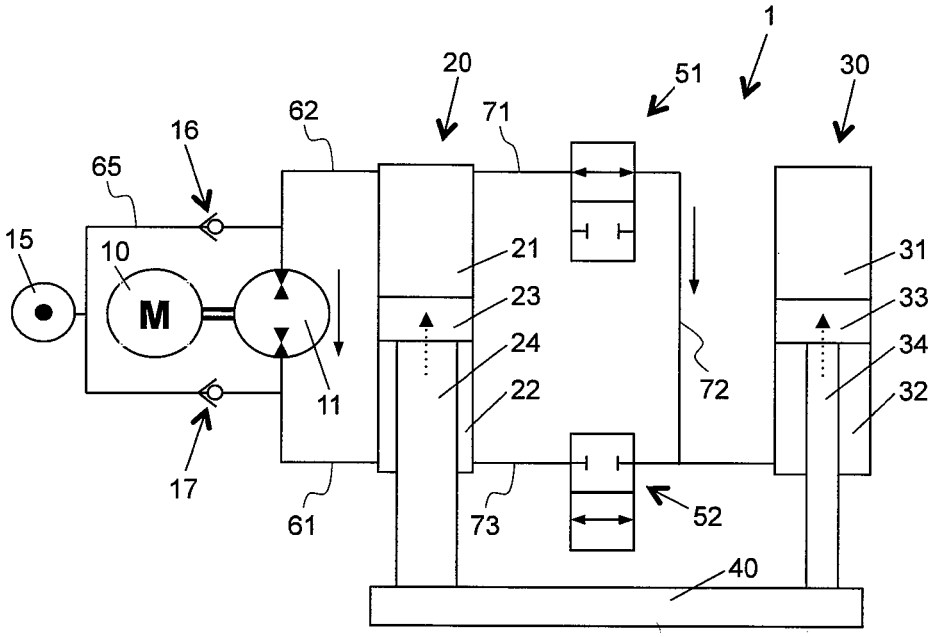
Figure 3A:
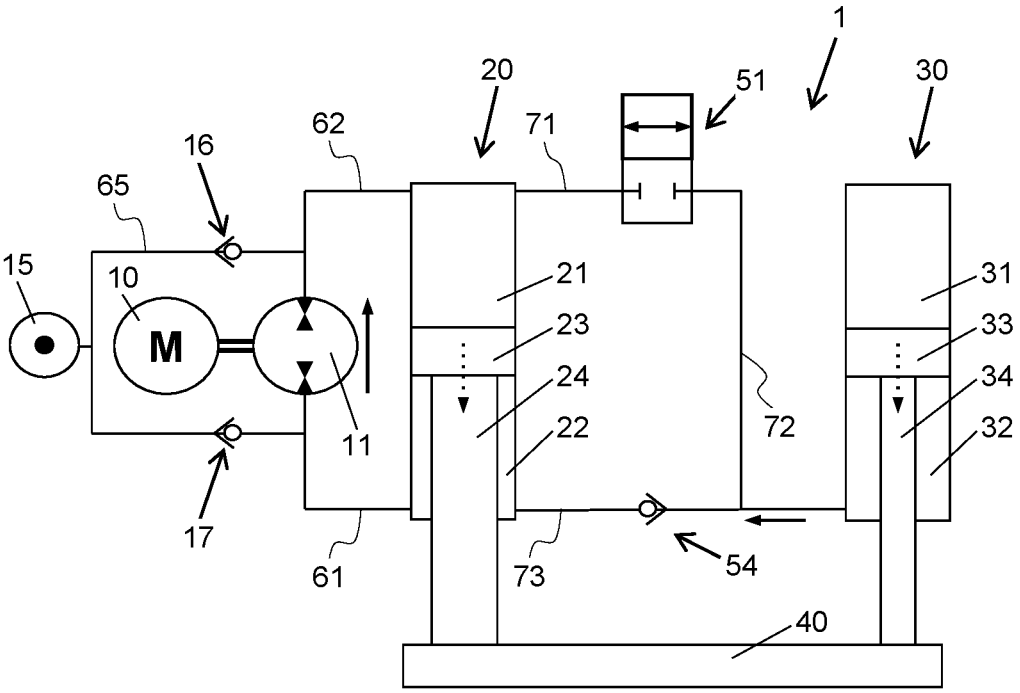
Figure 3B:
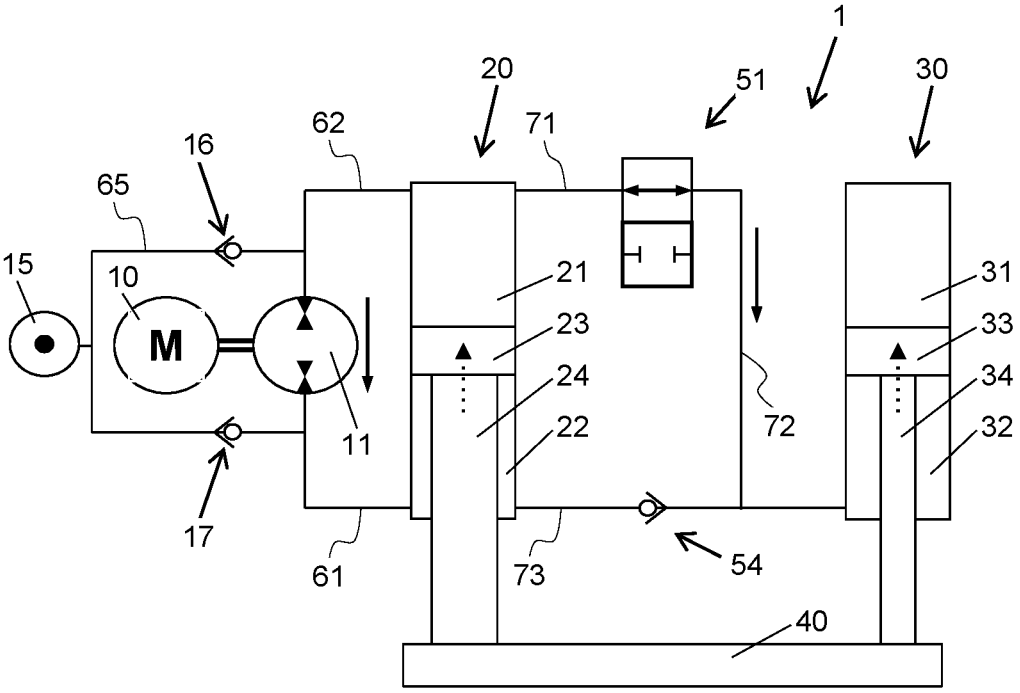
Figure 4A:
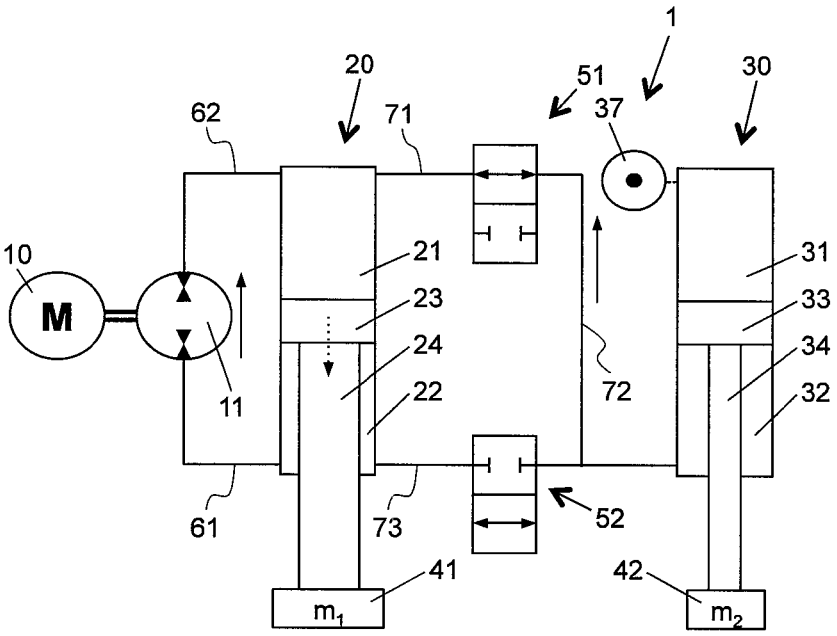
Figure 4B:
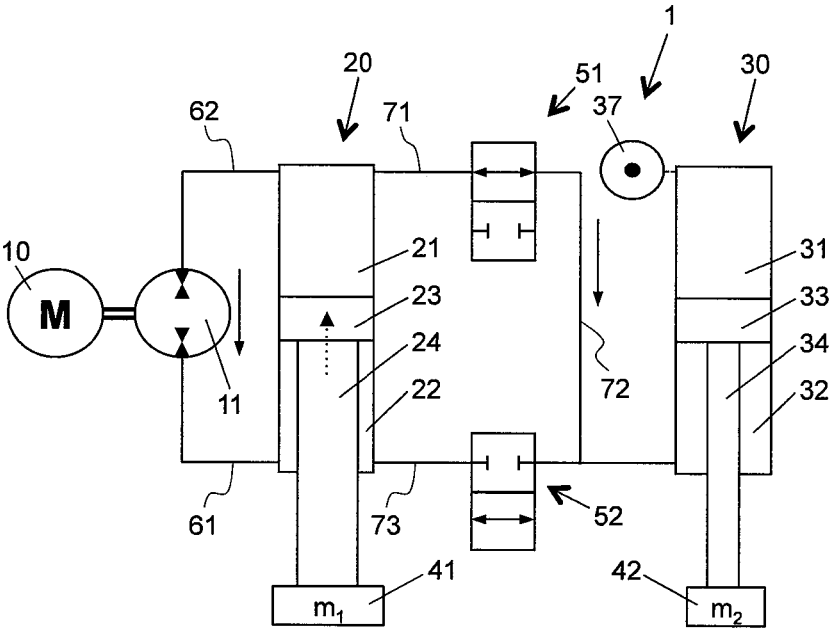
Figure 5A:
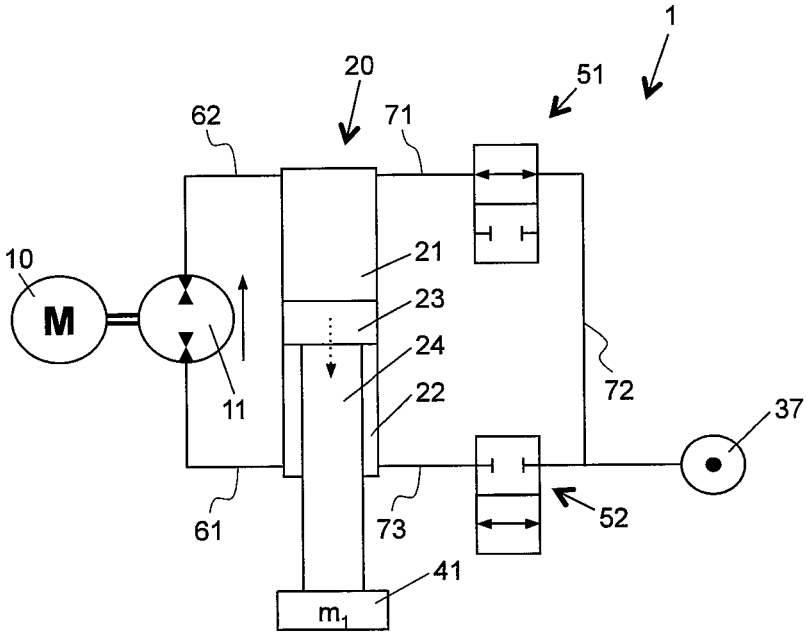
Figure 5B:
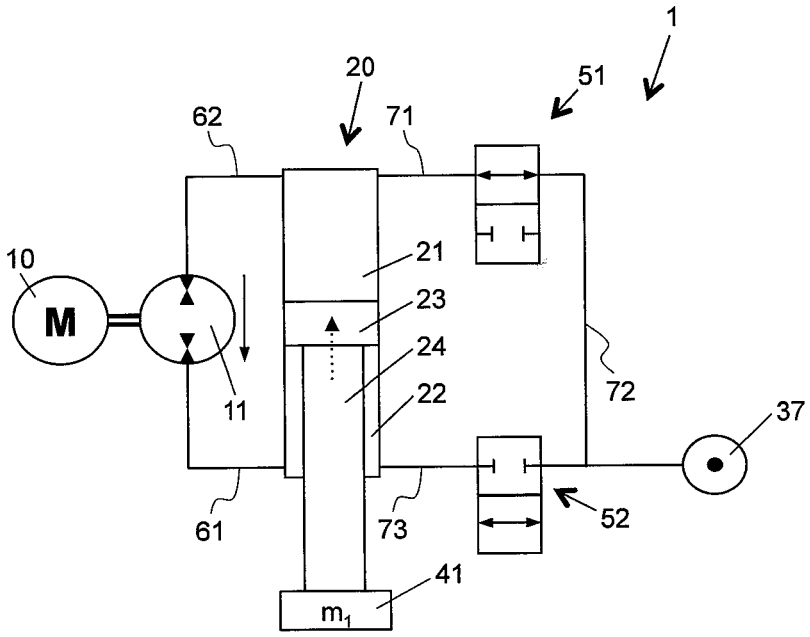

Thereby shown are:

FIG. 1*a*: schematic depiction of the configuration of a system according to the invention during extension in power operating mode;

FIG. 1*b*: schematic depiction of the configuration of a system according to the invention during retraction in power operating mode;

FIG. 2*a*: schematic depiction of the configuration of a system according to the invention during extension in speed operating mode;

FIG. 2*b*: schematic depiction of the configuration of a system according to the invention during retraction in speed operating mode;

FIG. 3*a*: schematic depiction of the configuration of a system according to the invention during extension, with a check valve;

FIG. 3*b*: schematic depiction of the configuration of a system according to the invention upon retraction, with a check valve;

FIG. 4*a*: schematic depiction of the configuration of a system according to the invention during extension in power operating mode, with separate mass and a pretensioning source;

FIG. 4*b*: schematic depiction of the configuration of a system according to the invention upon retraction in speed operating mode, with separate mass and a pretensioning source;

FIG. 5*a*: schematic depiction of the configuration of a system according to the invention during extension in speed operating mode, with hydraulic accumulator equalization container;

FIG. 5*b*: schematic depiction of the configuration of a system according to the invention upon retraction, with hydraulic accumulator equalization container.

FIG. 1*a* shows an electro-hydrostatic drive system 1 with a first cylinder or master cylinder 20 designed as a differential cylinder. The first cylinder 20 has a master cylinder piston 23 with a piston chamber 21 and an annular chamber 22. On the piston chamber 21 side, the master cylinder piston 23 has a piston rod 24 connected to a pressing tool 40.

The piston chamber 21 is connected to the pump 11 (hydraulic machine) via the conduit 62. The pump 11 is driven by an electric motor 10. The hydraulic machine may have either an electric motor with variable rotational speed and a fixed displacement pump, or an electric motor with constant rotational speed and a variable displacement pump, or an electric motor with variable rotational speed and a variable displacement pump. The annular chamber 22 is connected to the pump 11 via the conduit 61.

The pump 11 is connected to a pressure vessel 15 via the check valves 16 and 17. The check valves 16 or 17 thereby open if there is a lower pressure in the conduit 62 or 61 than in the pressure vessel 15. The dynamics of the system are thereby improved and/or energy is saved. In a variation, the pressure vessel 15 and the check valves 16 and 17 may be omitted, wherein the pretensioning of the system may then be provided by other measures, for example an external pressure source. According to the embodiments depicted here, both terminals of the hydraulic machine 11 are connected with the pretensioning source 15. Cavitation in the hydraulic machine is hereby advantageously avoided in pressure buildup phases or non-ideally balanced cylinder surfaces between master cylinder and cylinder equalization container.

The piston chamber 21 of the first cylinder 20 is connected to the annular chamber 32 of the second cylinder 30 via the conduit 71, the 2/2-port directional control valve 51, and the conduit 72. The annular chamber 22 of the first cylinder 20 is connected to the annular chamber 32 of the second cylinder 30 via the conduit 73, the 2/2-port directional control valve 52, and the conduit 72. A piston rod 34 is arranged in the annular chamber 32 at the piston 33 of the second cylinder 30. The piston rod 34 is connected to the common pressing tool 40, and in this way is mechanically coupled to the piston rod 24 of the first cylinder 20. According to the embodiments shown here, the effective annular surface of the second cylinder 30 is larger than the effective annular surface of the first cylinder 20. In the understanding of the present invention, the second cylinder thereby acts primarily as an equalization container which is able to compensate for volume displacements in the system. Moreover, and due to the coupling to the piston rod of the first cylinder 20, this also contributes to the movement of the pressing tool 40. According to the exemplary embodiments illustrated here, the piston rod diameter 24 is greater than or equal to the piston rod diameter 34. A system is herewith advantageously provided in which the full process force can be transmitted via piston rod 24 in power operating mode, and at the same time the buckling load of the piston rod 24 can be kept low. According to the exemplary embodiment shown here, the piston chamber 31 of the second cylinder 30 is open to the environment; it therefore represents no or only a very slight resistance for the piston 33 of the second cylinder 30.

Given extension of a system 1 according to the invention in power operating mode, the master cylinder piston 23 is driven downwards; see the dotted arrow on the master cylinder piston 23 and the piston rod 24. Since the piston rod 24 of the first cylinder 20 is mechanically coupled to the piston rod 34 of the second cylinder 30 via the common pressing tool 40, the piston 33 of the second cylinder 30 also moves downwards during extension; see the dotted arrow on the piston 33 and piston rod 34. For this purpose, the pump 11 generates a volumetric flow upwards, i.e. in the direction of the piston chamber 21; see the arrow next to the pump 11. The hydraulic fluid thereby flows from the pump 11 via the conduit 62 into the piston chamber 21, and hydraulic fluid flows from the annular chamber 22 into the pump 11.

Furthermore, the valve 51 is closed and the valve 52 is opened. Via this valve position and via the mechanical coupling via the pressing tool 40, hydraulic fluid flows from the annular chamber 32 of the second cylinder 30 via the lower part of the conduit 72—see the arrow arranged there—via the open valve 52 and conduits 73 and 61, into the pump 11. Via this measure, the different volumes of piston chamber 21 and annular chamber 22 of the first cylinder are compensated. Therefore, the hydraulic circuit in the system 1 can be closed.

FIG. 1*b* shows the configuration of a system 1 according to the invention according to FIG. 1*a*, upon retraction in power operating mode. The elements used and the reference symbols are thereby the same as in FIG. 1*a*.

Upon retraction in power operating mode, the master cylinder piston 23 is moved upwards; see the dotted arrow at master cylinder piston 23 and piston rod 24. Due to the common pressing tool 40, piston 33 of the second cylinder 30 likewise moves upwards. A downward volumetric flow, i.e. in the direction of the annular chamber 22, is generated by the pump 11; see the arrow next to the pump 11. Furthermore, the valve 51 is closed and the valve 52 is opened. Hydraulic fluid thereby flows from the piston chamber 21 into the annular chambers 22 and 32 of the first or second cylinder. The power operating mode results from the summary effect of the two annular surfaces of the annular chambers 22 and 32.

FIG. 2*a* shows the configuration of a system 1 according to the invention according to FIG. 1*a*, upon extension in speed operating mode. The elements used and the reference symbols are thereby the same as in FIG. 1*a*.

In speed operating mode, the pump 11 generates a volumetric flow upwards, i.e. in the direction of the piston chamber 21; see the arrow next to the pump 11. The hydraulic fluid thereby flows from the pump 11 via the conduit 62 into the piston chamber 21, and from the annular chamber 22 into the pump 11. In contrast to power operating mode, in speed operating mode the valve 51 is open and the valve 52 is closed. As a result, hydraulic fluid flows from the annular chamber 32 of the second cylinder 30 directly into the piston chamber 21 via the conduit 72, valve 51, and conduit 71.

FIG. 2*b* shows the configuration of a system 1 according to the invention upon retraction in speed operating mode. The elements used and the reference symbols are thereby the same as in FIG. 1*a*.

A downward volumetric flow, i.e. in the direction of the annular chamber 22, is thereby generated by the pump 11; see the arrow next to the pump 11. The hydraulic fluid thereby flows from the pump 11 via the conduit 61 into the annular chamber 22. The valve 51 is open and the valve 52 is closed. As a result, hydraulic fluid also flows from the piston chamber 21 of the first cylinder into the annular chamber 32 of the second cylinder 30 via the conduit 71, valve 51, and conduit 72.

FIG. 3*a* shows the configuration of a system 1 according to the invention upon extension, here in power operating mode. Most of the elements used and the reference symbols are thereby the same as in FIG. 1*a*. One exception is the check valve 54, which replaces the valve 52.

According to a particularly preferred embodiment, the pressure vessel 15 may be executed as a low-pressure vessel. Among other things, advantages in terms of a more compact design may hereby be realized, whereby a cost saving results and an easier design may be realized.

The movement sequence is the same as in FIG. 1*a*; however, the check valve 54 always opens in one direction as of a certain pressure, corresponding to the arrow at conduit 72.

FIG. 3*b* shows the configuration of a system 1 according to the invention upon retraction, here in speed operating mode. Most of the elements used and the reference symbols are thereby the same as in FIG. 1*a*. One exception is again the check valve 54, which replaces the valve 52.

The movement sequence is the same as in FIG. 2*b*; however, the check valve 54 is always closed in the direction of the annular chamber 32 as of a certain pressure.

FIG. 4*a* shows the configuration of a system 1 according to the invention upon extension, here in speed operating mode. Most of the elements used and the reference symbols are thereby the same as in FIG. 1*a*. One exception is the separate masses 41 and 42, instead of the mechanical coupling of the two piston rods 24 and 34 by the pressing tool 40. Moreover, the pressure accumulator 37 is provided which is connected to the—now closed—piston chamber 31 of the second cylinder. The pressure vessel 15 and the check valves 16 and 17 have been omitted.

The separated masses $m_1$ 41 and $m_2$ 42 no longer force—as was the case with the common mass 40—a coupled movement of the piston rod 24 and 34 of the first and of the second cylinder 20 and 30. However, the mass $m_2$ 42 charges the chamber 32 with a pressure, meaning that the system is hereby at least partially pretensioned. The movement sequence of the piston rod of the first cylinder 20 is also comparable to that in the description regarding FIG. 2*a*.

The pressure accumulator 37 represents a further increase in the reserve pressure and produces greater dynamics of the system, or further savings in energy consumption. Alternatively, for certain configurations of the system the additional mass $m_2$ 42 can be dispensed with if an additional mass $m_2$ 42—or a larger common mass 40—appears to be disadvantageous.

The optional omission of the pressure vessel 15 and the check valves 16 and 17 may be compensated for either via measures such as an additional mass $m_2$ 42 and/or the pressure accumulator 37. Alternatively, this omission leads to lower costs of the system 1.

In a further alternative embodiment, the pressure accumulator 37 may optionally also be dispensed with, so that the pretensioning is provided by the second cylinder itself. For example, this may be effected in that the pretensioning in the hydraulic fluid is generated by the own weight of the cylinder and/or of the cylinder rod.

The movement sequence of the piston rod of the first cylinder is—with the cited changes—comparable to that in FIG. 2*b*.

FIG. 4*b* shows the configuration of a system 1 according to the invention according to FIG. 1*a* upon retraction in speed operating mode. Most of the elements used and the reference symbols are thereby the same as in FIG. 1*a*. One exception is thereby again the separate masses 41 and 42, instead of the mechanical coupling of the two piston rods 24 and 34 by the pressing tool 40. Moreover, a pressure accumulator 37 is provided which is connected to the—now closed—piston chamber 31 of the second cylinder. The pressure vessel 15 and the check valves 16 and 17 have also been omitted.

The movement sequence of the piston rod of the first cylinder 20 is comparable to that of FIG. 2*b* for the reasons explained in the description of FIG. 4*a*.

FIG. 5*a* shows the configuration of a system 1 according to the invention upon extension, in speed operating mode. Most of the elements used and the reference symbols are thereby the same as in FIG. 1*a*. One exception is the equalization container 37, which replaces the second cylinder 30, wherein this equalization container provides both a predetermined pressure level and an equalization volume. Furthermore, the pressure vessel 15 and the check valves 16 and 17 have been omitted.

Since, in a system 1 according to the invention, the second cylinder 30 is used as an equalization container which—together with the hydraulic machine 11—provides a volumetric flow, here too the movement sequence of the piston rod of the first cylinder 20 is comparable to FIG. 2*a*.

FIG. 5*b* shows the configuration of a system 1 according to the invention upon retraction in speed operating mode. Most of the elements used and the reference symbols are thereby the same as in FIG. 1*a*. Here, too, the second cylinder 30 has been replaced by the pressure accumulator 37. Furthermore, the pressure vessel 15 and the check valves 16 and 17 have been omitted.

Since, in a system 1 according to the invention, the second cylinder 30 is used as an equalization container which—together with the hydraulic machine 11—provides a volumetric flow, here too the movement sequence of the piston rod of the first cylinder 20 is comparable to FIG. 2*b*.

In a further embodiment, a check valve 54 as is arranged in FIGS. 3*a* and 3*b* may also be adopted analogously into the embodiments according to FIG. 4*a*, 4*b*, 5*a*, 5*b*.

Furthermore, in particular FIGS. 3*b*, 5*a* and 5*b* show that, in a system according to the invention, the second cylinder 30 is used as equalization container and does not represent a second operative cylinder.

LIST OF REFERENCE CHARACTERS

1 Electro-hydrostatic system
10 Electric motor
11 Pump
15 Pressure vessel
16, 17 Check valve
20 Master cylinder, first cylinder
21 Piston chamber
22 Annular chamber
23 Master cylinder piston
24 Piston rod
30 Second cylinder, secondary cylinder
31 Piston chamber
32 Annular chamber
33 Secondary cylinder piston
34 Piston rod
37 Equalization container
40 Pressing tool
41 Mass $m_1$
42 Mass $m_2$
51 Directional control valve
52 Directional control valve
54 Check valve
61, 62, 65 Conduit
71, 72, 73 Conduit

The invention claimed is:

1. An electro-hydrostatic drive system comprising:

a hydraulic machine driven by an electric motor and having a variable displacement volume and/or rotational speed, operable to provide a volumetric flow rate of a hydraulic fluid, a first differential cylinder including a piston having a front side and a rear side to which a rod is attached, the first differential cylinder having a piston chamber with a piston area on the front side of the piston and having an annular chamber with an annular area on the rear side of the piston;

at least one equalization container, and a preload source connected with the piston chamber via a first check-valve and connected with the annular chamber via a second check-valve, wherein during operation, the drive system has a closed hydraulic circuit including a plurality of conduits, and wherein the preload source is operable to provide the drive system with an overpressure relative to the environment, wherein the drive system is operable to provide a movement of the piston of the first differential cylinder in a first direction as a function of a volumetric flow of the hydraulic machine through one of the plurality of conduits into the piston chamber and a volumetric flow from the equalization container through a check-valve conduit to the annular chamber, wherein the check-valve conduit has only a third check valve and has only a single branch conduit positioned between the third check valve and the equalization container, wherein the drive system is operable to provide the movement of the piston of the first differential cylinder in a second direction as a function of a volumetric flow of the hydraulic machine through another of the plurality of conduits into the annular chamber and a volumetric flow through the branch conduit into the equalization container, wherein both sides of the hydraulic machine are connected with the preload source, whereby the hydraulic machine is operable to transmit a preload in the hydraulic fluid of the closed hydraulic circuit, wherein a first side of the hydraulic machine is connected with the piston chamber without any intervening components, and a second side of the hydraulic machine is connected with the annular chamber without any intervening components, and wherein the third check valve connected between the annular chamber and the equalization container provides one-way flow into the annular chamber when pressure in the annular chamber drops below a certain pressure.

2. The electro-hydrostatic system according to claim 1, wherein the equalization container is designed as a second cylinder containing a second piston having a front side and a rear side to which a second piston rod is attached, the second cylinder having a second piston chamber with a second piston area on the front side of the second piston and having a second annular chamber with a second annular area on the rear side of the second piston.

3. The electro-hydrostatic system according to claim 2, wherein the second cylinder is a second differential cylinder, and the second annular area corresponds to the difference between the piston area and the annular area of the first differential cylinder.

4. The electro-hydrostatic system according to claim 2, wherein the piston rod of the first differential cylinder and the piston rod of the second cylinder are mechanically coupled.

5. The electro-hydrostatic system according to claim 2, wherein the annular area of the first differential cylinder is less than or equal to the second annular area of the second cylinder.

6. An electro-hydrostatic drive system comprising:

a hydraulic machine driven by an electric motor and having a variable displacement volume and/or rotational speed, operable to provide a volumetric flow rate of a hydraulic fluid;

a first differential cylinder including a piston having a front side and a rear side to which a rod is attached, the first differential cylinder having a piston chamber with a piston area on the front side of the piston and having an annular chamber with an annular area on the rear side of the piston;

at least one equalization container; and a preload source connected with the piston chamber via a first check-valve and connected with the annular chamber via a second check-valve;

wherein during operation, the drive system has a closed hydraulic circuit including a plurality of conduits, and wherein the preload source is operable to provided the drive system with an overpressure relative to the environment;

wherein the drive system is operable to provides a movement of the piston of the first differential cylinder in a first direction as a function of a volumetric flow of the hydraulic machine through one of the plurality of conduits into the piston chamber and a volumetric flow from the equalization container through a check-valve conduit to the annular chamber, wherein the check-valve conduit has only a third check valve and has only a single branch conduit positioned between the third check valve and the equalization container, wherein the drive system is operable to provide the movement of the piston of the first differential cylinder in a second direction as a function of a volumetric flow of the hydraulic machine through another of the plurality of conduits into the annular chamber and a volumetric flow through the branch conduit into the equalization container, wherein a first side of the hydraulic machine is connected with the piston chamber without any intervening components, and a second side of the hydraulic machine is connected with the annular chamber without any intervening components, and wherein the piston chamber of the first differential cylinder is connected with the equalization container via the branch conduit, the annular chamber being connected with the equalization container through the check-valve conduit, wherein the check valve connected between the annular chamber and the equalization container provides one-way flow into the annular chamber when pressure in the annular chamber drops below a certain pressure.

7. The electro-hydrostatic system according to claim 6, wherein the equalization container is designed as a second differential cylinder containing a second piston having a front side and a rear side to which a second piston rod is attached, the second differential cylinder having a second piston chamber with a second piston area on the front side of the second piston and having a second annular chamber with a second annular area on the rear side of the second piston.

8. The electro-hydrostatic system according to claim 7, wherein the second cylinder is a second differential cylinder, and the second annular area corresponds to the difference between the piston area and the annular area of the first differential cylinder.

9. The electro-hydrostatic system according to claim 7, wherein the piston rod of the first differential cylinder and the piston rod of the second cylinder are mechanically coupled.

10. The electro-hydrostatic system according to claim 7, wherein the annular area of the first differential cylinder is less than or equal to the second annular area of the second cylinder.

* * * * *